US005584143A

United States Patent [19]

Kennedy

[11] Patent Number: 5,584,143

[45] Date of Patent: Dec. 17, 1996

[54] EDGE SEAL GASKET ASSEMBLY FOR A MULTIPLE GLAZING UNIT

[75] Inventor: Thomas E. Kennedy, Niles, Mich.

[73] Assignee: Tyler Refrigeration Corporation, Niles, Mich.

[21] Appl. No.: 60,180

[22] Filed: May 7, 1993

[51] Int. Cl.[6] ..... E06B 3/00

[52] U.S. Cl. ..... 49/501; 49/492.1

[58] Field of Search ..... 49/492.1, 493.1, 49/483.1, 475.1, 501

[56] References Cited

U.S. PATENT DOCUMENTS

| | | | |
|---|---|---|---|
| 1,974,638 | 9/1934 | Axe | 49/493.1 |
| 3,105,274 | 10/1963 | Armstrong . | |
| 3,280,523 | 10/1966 | Stroud et al. . | |
| 3,374,580 | 3/1968 | Ruff | 49/493.1 |
| 3,377,748 | 4/1968 | Kellerhals | 49/501 |
| 3,386,209 | 6/1968 | Starcevic | 49/492.1 |
| 3,531,896 | 10/1970 | Dean | 49/483.1 |
| 3,535,824 | 10/1970 | Kessler | 49/475.1 |
| 3,668,807 | 6/1972 | Thompson | 49/501 |
| 3,750,333 | 8/1973 | Vance | 49/501 |
| 3,908,313 | 9/1975 | Bierlich | 49/501 |
| 4,042,736 | 8/1977 | Flint . | |
| 4,649,685 | 3/1987 | Wolf et al. . | |
| 4,909,875 | 3/1990 | Canaud et al. . | |
| 4,950,344 | 8/1990 | Glover et al. . | |
| 4,998,392 | 3/1991 | Massarelli et al. . | |
| 5,061,531 | 10/1991 | Catalano . | |
| 5,184,423 | 2/1993 | McCarty | 49/501 |
| 5,255,473 | 10/1993 | Kaspar et al. | 49/501 |

FOREIGN PATENT DOCUMENTS

| | | | |
|---|---|---|---|
| 399925 | 4/1966 | Switzerland | 49/483.1 |
| 515885 | 12/1939 | United Kingdom | 49/483.1 |

*Primary Examiner*—Michael J. Milano
*Attorney, Agent, or Firm*—Baker & Daniels

[57] ABSTRACT

An edge seal gasket assembly for use in a multi-glazed window or door. The edge seal gasket assembly having a flange gasket fitted into the inset spacer between the separated panes of glass and embedded by a sealant compound on either side of the flange gasket. The flange gasket extending outward from between the panes to provide an edge seal gasket for sealing engagement with the sides of the insulated casing or another edge gasket.

6 Claims, 1 Drawing Sheet

EDGE SEAL GASKET ASSEMBLY FOR A MULTIPLE GLAZING UNIT

This invention relates to an edge seal gasket assembly for use in a multi-glazed window or door and, in particular, an edge seal gasket assembly with a flange gasket fitted into an inset spacer and extending outward from the multi-glazed door.

BACKGROUND OF THE INVENTION

Single and multi-glazed door and window units are used in many applications. In applications where heat transfer is a concern, such as refrigerators, multi-glazed units are preferred. The vacuum enclosure created by the spaced panes of glass reduce heat transfer across the window or door surface. Conventional multi-glazed doors use edge seal assemblies with elongated spacers to separate the panes of glass and sealant compounds to secure the panes together and vacuum seal the enclosed interior. Hinged or sliding glass window or doors require additional edge seals or gaskets around the periphery of the doors to prevent heat transfer through the gaps between the sides of the refrigerator cases and the glass doors. Because of the construction of conventional edge seal assemblies, multi-glazed doors require additional edge molding or framing to support the edge gaskets. The additional molding and framing increases production costs for multi-glazed doors.

SUMMARY OF THE INVENTION

The multi-glazed unit of this invention includes an edge seal gasket assembly in combination with a pair of spaced panes of glass. The edge seal gasket assembly of this invention allows a multi-glazed window or door to support an edge seal gasket as an integrated part of the edge seal assembly. With the edge seal gasket incorporated into the edge seal assembly, this invention eliminates the need for any additional molding or frame work. The edge seal gasket assembly includes an elongated flange gasket, which is preferably securely fitted into the spacer. In another embodiment, a separate connection part can be combined with a conventional spacer. With the flange gasket so secured, the spacer being inset from the edge of the glass panes is packed with a sealant compound which extends around both sides of the flange gasket to seal and secure the glass panes together.

Accordingly, an object of this invention is to provide for an edge seal gasket assembly for use with a multi-glazed window or door.

Another object is to provide for an edge seal gasket assembly for a multi-glazed window or door which includes a flange gasket fitted into the spacer and extending from the edge of the multi-glazed unit to form an edge seal gasket.

Other objects will become apparent upon a reading of the following description.

BRIEF DESCRIPTION OF THE DRAWINGS

Preferred embodiments of the invention have been depicted for illustrative purposes only wherein.

DESCRIPTION OF THE PREFERRED EMBODIMENTS

The preferred embodiments herein described are not intended to be exhaustive or to limit the invention to the precise forms disclosed. They are chosen and described to explain the principles of the invention and its application and practical use to enable others skilled in the art to utilize its teachings.

Figure 3:
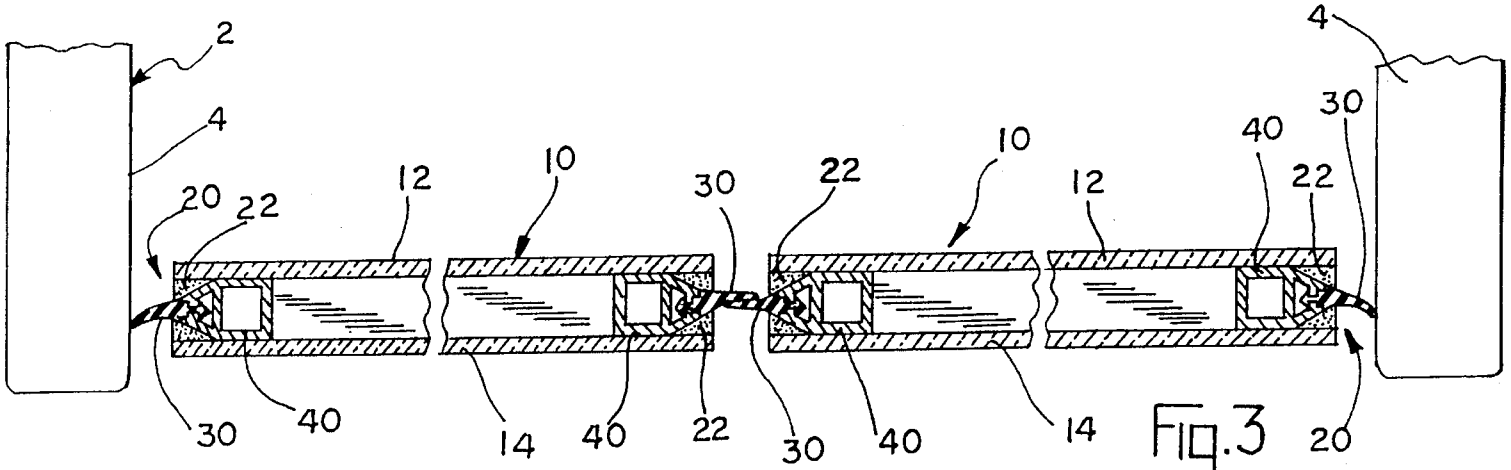
FIG. 3 is a sectional view of two lift up type multi-glazed doors using the edge seal gasket assembly of this invention and mounted within a case.

The edge seal gasket assembly 20 of this invention forms part of a multi-glazed window or door unit 10. Edge seal gasket assembly 20 can be used with any type of multi-glazed door and is not limited to any particular embodiment of multi-glazed unit. Edge seal gasket assembly 20 is shown in FIG. 3 used to provide an air tight edge seal between a hinged or sliding multi-glazed door 10 and the sides or frame 4 of an insulated refrigerator case 2.

Figure 2:
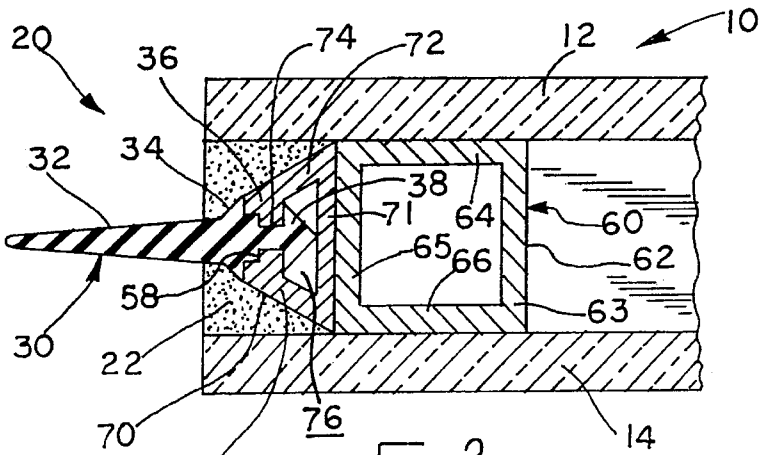
FIG. 2 is a sectional view of another embodiment of the edge seal gasket assembly of this invention.
Figure 1:
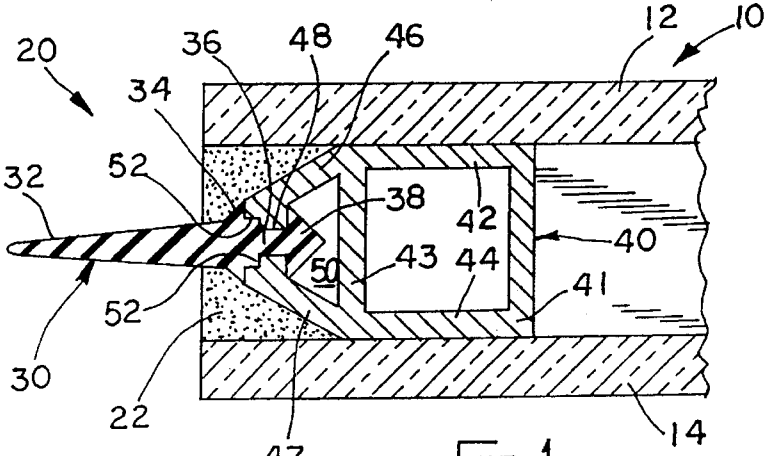
FIG. 1 is sectional view of the edge seal gasket assembly of this invention used in a multi-glazed glass unit.

As shown in FIGS. 1 and 2, edge seal gasket assembly 20 is used to separate and enclosed the edges of two spaced glass panes 12, 14 to form vacuum sealed multi-glazed door 10. Preferably, panes 12, 14 are constructed of tempered glass to provide structural strength and a high insulation value, but other suitable glass materials can be employed for various applications. Edge seal gasket assembly 20 includes an elongated spacer (40 in FIG. 1, and 60 in FIG. 2), an elongated flange strip or flange gasket 30 and a sealant compound 22, which surrounds flange gasket 30 over the spacer. Glass panes 12, 14 are separated by the spacer, which is inset from the edge of panes 12, 14 to form an edge cavity 16. Flange gasket 30 extends beyond the edge of the panes 12, 14 from within cavity 16. Cavity is filled with a sealant compound 22, such as a silicone gel, to secure and seal panes 12, 14 together and to support flange gasket 30 within cavity 16.

Flange gasket 30 is constructed from any pliable wear resistent material that is suitable for providing an air tight seal, such as butyl rubber. Both FIGS. 1 and 2 show that in cross section flange gasket 30 has an elongated axially symmetrical tapered body 32. The tapered end forms the edge seal gasket for multi-glazed door 10 as described in more detail hereafter. A rib 34 extends on either side of gasket body 32. A reduced neck part 36 extends axially from gasket body 32 with the gasket terminating at its inner end in a head part 38. Head part 38 has a convergent tapered end to facilitate the press fit connection of flange gasket 30 into the spacer.

FIGS. 1 and 2 show two different embodiments of edge seal gasket assembly 20. FIG. 1 shows edge seal gasket assembly 20 with a single piece spacer 40. FIG. 2 shows edge seal gasket assembly 20 with a two piece spacer 60. Generally, both spacers are extruded from a suitable material that provides sufficient structural support and thermal insulation, such as aluminum or plastic.

As shown in FIG. 1, spacer 40 has a square body in cross-section with four walls 41, 42, 43, 44. Side wall 42 abuts against the inner face of pane 12 and side wall 44 abuts against the inner face of pane 14. Sealant compound 22 secures spacer 40 in position between panes 12, 14. Spacer 20 includes two converging side extension members 46, 47 that extend from the corners of sides 42, 43 and 44. Side extension members 46, 47 with wall 43 define an elongated open channel 50. Each side extension member 46, 47 includes an in-turned ridge 48 at the mouth of channel 50.

As shown in FIG. 2, spacer 60 includes a separate body part 82 and a separate connection part 70. Body part 62 has a square cross-sectional configuration with side walls 63, 64, 65, 66. Side wall 64 abuts against the inner face of pane 12 and side wall 66 abuts against the inner face of pane 14. Connection part 70 includes a back 71 and two converging side extension members 72, 73. Back 71 abuts flat against end wall 65 of body part 62. Connection part 70 is secured to body part 62 by any conventional method, such as by an adhesive, and held secured between panes 12, 14 by sealant compound 22. Alternatively, body part 62 can be secured to between glass panes 12, 14 by an adhesive placed on either of side walls 64, 66 and connection part 70 held in position against body part 62 by sealant compound 22. Again, side extension members 72, 73 and back 71 define an elongated open channel 76. Each side extension member 72, 73 includes an in-turned ridge 74 at the mouth of channel 76.

As shown in FIGS. 1 and 2 for both embodiments, flange gasket 30 is fitted within either of the embodiments of the spacers. For simplicity, only the connection of the embodiment of FIG. 1 will be described in detail herein; however, it should be understood that the connection between flange gasket and the spacer of the embodiment in FIG. 2 is in substantially the same way. Flange gasket 30 is press fitted into spacer channel 50 between the spaced in-turned ridges 48 of the spacer. Head portion 38 of flange gasket 30 is tapered to facilitate the press fit connection into spacer channel 50. Ridges 48 of side extension members 46, 47 protrude into the grooves formed at neck part 36 to prevent flange gasket 30 from being pulled out of spacer 40. Ribs 34 abut against outer shoulders 52 of the side extension members 46, 47.

In both embodiments, the spacer and flange gasket combination is sandwiched between glass panes 12, 14. The spacer is inset from the aligned edges of glass panes 12, 14 to form an end cavity 16 between panes 12, 14. The tapered end 31 of flange gasket 30 forms the edge seal gasket for door 10. Sealant compound 22 completely fills cavity 16 on either side of flange gasket 30, overlying the outer surfaces of side extension member 46, 47, 72, 73. Sealant compound 22 secures panes 12, 14 together against the spacer and provides the vacuum seal for the multi-glazed door 10. Furthermore, sealant compound 22 helps assists in securing flange gasket 30 in position within cavity 16 and prevents the spacer from shifting relative to the glass panes.

With the gasket body 32 protruding from cavity 16 beyond the aligned edges of panes 12, 14, flange gasket 30 provides a ready seal gasket for engagement with the sides of case 2 or another edge seal gasket. FIG. 3 shows a top plan view of a pair of multi-glazed doors with edge seal gaskets assemblies of this invention used in an insulated case 2 with a lift up type multi-glazed door application. Multi-glazed window or door can be vertically or horizontally hinged to the frame or side walls of the insulated case depending on the application. As shown in FIG. 3, the tapered ends of the flange gaskets extend beyond the edges of each doors 10 to engage the stationary sides 4 of the insulated case 2 or the flange gaskets of another door 10.

It is understood that the above description does not limit the invention to the details given, but may be modified within the scope of the following claims.

I claim:

1. In combination an edge seal gasket assembly and a pair of spaced panes forming a multiple glazed door or window unit comprising:

spacer means located between said panes for separating said panes, said spacer means being inset from corresponding edges of said panes to define a cavity between said spacer means and said pane edges, a resilient gasket means having a first part within said cavity and a second part extending outwardly from said cavity, and sealant means filling said cavity around said gasket means first part for sealing said panes together and securing said gasket means within the cavity.

2. The combination of claim 1 wherein said gasket means engages said spacer means.

3. In combination an edge seal gasket assembly and a pair of spaced panes forming a multiple glazed door or window unit comprising: spacer means located between said panes for separating said panes, said spacer means being inset from corresponding edges of said panes to define a cavity between the spacer means and said pane edges, gasket means having a first part within said cavity and a second part extending outwardly from said cavity, sealant means filling said cavity around said gasket means first part for sealing said panes together and securing said gasket means within the cavity, said gasket means engaging said spacer means, said spacer means including channel defining parts, said gasket means first part fitted into said channel defining parts.

4. The combination of claim 3 wherein said channel defining parts include opposed in-turned ridges, said gasket means first part including a neck, said in-turned ridges fitting into said neck whereby said gasket means is interlocked within said spacer means.

5. In combination an edge seal gasket assembly and a pair of spaced panes forming a multiple glazed door or window unit comprising: spacer means located between said panes for separating said panes, said spacer means being inset from corresponding edges of said panes to define a cavity between the spacer means and said pane edges, gasket means having a first part within said cavity and a second part extending outwardly from said cavity, sealant means filling said cavity around said gasket means first part for sealing said panes together and securing said gasket means within the cavity, said gasket means engaging said spacer means, and a connection part, said connection part abutting said spacer means within said cavity, said connection part including channel defining parts, said gasket means first part fitted into said channel defining parts.

6. The assembly of claim 5 wherein said channel defining parts include opposed in-turned ridges, said gasket means first part including a neck, said in-turned ridges fitting into said neck whereby said gasket means is interlocked within said spacer means.

* * * * *